US009331441B2

(12) United States Patent
Roy et al.

(10) Patent No.: US 9,331,441 B2
(45) Date of Patent: May 3, 2016

(54) POWER ADAPTER WITH RETRACTABLE PRONGS

(71) Applicant: APPLE INC., Cupertino, CA (US)

(72) Inventors: Mathieu P. Roy, Sunnyvale, CA (US); Cesar Lozano Villarreal, Santa Clara, CA (US); Vikas K. Sinha, Redwood City, CA (US); Daniel Coster, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/484,145

(22) Filed: Sep. 11, 2014

(65) Prior Publication Data

US 2015/0364882 A1 Dec. 17, 2015

Related U.S. Application Data

(60) Provisional application No. 62/013,437, filed on Jun. 17, 2014.

(51) Int. Cl.

| | |
|---|---|
| ***H01R 29/00*** | (2006.01) |
| ***H01R 24/68*** | (2011.01) |
| ***H01R 24/30*** | (2011.01) |
| ***H01R 13/434*** | (2006.01) |

(52) U.S. Cl.
CPC ..... *H01R 24/68* (2013.01); *H01R 13/434* (2013.01); *H01R 24/30* (2013.01)

(58) Field of Classification Search
CPC ..... H01R 35/04
USPC ..... 439/131
See application file for complete search history.

(56) References Cited

U.S. PATENT DOCUMENTS

| | | | | |
|---|---|---|---|---|
| 3,025,486 | A * | 3/1962 | Falconer | H01R 27/00 439/103 |
| 3,519,914 | A * | 7/1970 | Fujimaki | H02J 7/0042 320/111 |
| 4,467,263 | A * | 8/1984 | Conforti | F21L 4/085 320/111 |
| 5,474,464 | A * | 12/1995 | Drewnicki | H01R 31/06 439/143 |
| 5,611,701 | A * | 3/1997 | Hahn | H01R 24/66 439/131 |
| 6,241,538 | B1 * | 6/2001 | Chen | H01R 13/71 439/131 |
| 6,780,034 | B2 * | 8/2004 | Shiroshita | H01R 31/06 439/174 |
| 6,939,150 | B1 * | 9/2005 | Lanni | H01R 35/04 439/131 |
| 7,354,286 | B1 * | 4/2008 | Lee | H01R 13/652 439/131 |
| 7,604,492 | B1 * | 10/2009 | Wang | H01R 24/30 439/131 |

(Continued)

OTHER PUBLICATIONS

Dongguan Shangge Electronic Co., Ltd., "Foldable pins UK USB charger adaptor 2A," http://dgsge.en.alibaba.com/product/955748375-218891485/Foldable_pins_UK_USB_charger_adaptor_2A.html, downloaded May 29, 2014, 2 pages.

*Primary Examiner* — Neil Abrams
(74) *Attorney, Agent, or Firm* — Kilpatrick Townsend & Stockton LLP

(57) ABSTRACT

An electrical power adapter has first and second prongs that are retractable and deployable. When the prongs are in the deployed position the adapter may be mated with a receptacle and when in the retracted position the adapter has a reduced physical size. A linkage couples the first prong to the second prongs such that the first and second prongs retract and deploy simultaneously. An actuation mechanism causes the prongs to have a first detent in the deployed position and a second detent in the retracted position.

20 Claims, 9 Drawing Sheets

(56) References Cited

U.S. PATENT DOCUMENTS 7,614,892 B2 * 11/2009 Klant ..... H01R 31/06 439/172
8,096,817 B2 * 1/2012 Lee ..... H01R 35/04 439/104
8,366,461 B2 * 2/2013 Lee ..... H01R 24/30 439/131
8,410,752 B2 * 4/2013 Sulem ..... H01R 24/28 320/111
8,480,416 B2 * 7/2013 Farris-Gilbert ..... H01R 13/652 439/131
9,077,093 B1 * 7/2015 Roy ..... H02K 49/10
2015/0364882 A1 * 12/2015 Roy ..... H01R 13/434 439/131

* cited by examiner

POWER ADAPTER WITH RETRACTABLE PRONGS

CROSS-REFERENCES TO RELATED APPLICATIONS

This application claims the benefit of U.S. Provisional Application No. 62/013,437, filed Jun. 17, 2014, which is incorporated by reference herein in its entirety for all purposes.

FIELD

The described embodiments relate generally to electrical power adapters. More particularly, the present embodiments relate to electrical power adapters for use with standard alternating current (AC) power sockets employed in residential and commercial buildings.

BACKGROUND

Electrical power adapters are used for a wide variety of applications, facilitating the supply of electrical power to a myriad of electronic devices including smart-phones, media players, and other personal electronic systems.

As smart-phones, media players, and other electronic systems become more compact, a limiting factor on the size of the package in which the systems are shipped and sold may be the size of the electrical power adapter used to charge the electronic system. As an example, a portable media player may be packaged along with a BS1363 (Type G) electrical power adapter, used in the United Kingdom, where the media player is actually smaller than the electrical power adapter. Such large power adapters may therefore contribute to increased shipping costs for the electrical systems and may also be difficult for the user to conveniently store and transport.

New electrical power adapters may require new features to reduce their physical size, enabling reduced shipping costs and added convenience for the user.

SUMMARY

Embodiments of the invention pertain to electrical power adapters for use with a variety of electronic devices. In some embodiments, an electrical power adapter according to the invention includes collapsible prongs configured to provide reduced size and improved usability. A reduction in size allows for a reduction in total packaging, which may enable lower packaging and/or shipping costs.

Some embodiments of the present invention relate to improved electrical power adapters having retractable prongs that can be inserted into an electrical outlet. The prongs can be pivoted from a retracted position in which the retractable prongs are positioned adjacent to the adapter housing, to a deployed position in which the retractable prongs extend away from the adapter housing, and can be inserted into an electrical outlet. In one embodiment a first retractable prong is coupled to a first rotatable shaft within the housing such that the first retractable prong can be pivoted from the retracted position, to the deployed position, while a second retractable prong may be coupled to a second rotatable shaft within the housing such that the second retractable prong can also be pivoted from a retracted position to a deployed position.

Further embodiments may include a linkage having a first portion connected to the first rotatable shaft and a second portion connected to the second rotatable shaft and configured to transfer force such that when the first retractable prong is pivoted from the retracted position to the deployed position, the second retractable prong is simultaneously pivoted from the retracted position to the deployed position.

In some embodiments the linkage may comprise a planar quadrilateral linkage with a clevis-type configuration such that it may be attached to two second retractable prongs. In other embodiments the linkage may comprise a pin and slot configuration while still other embodiments may employ a belt-type linkage.

Further embodiments may comprise an actuation mechanism that may cause the first rotatable shaft and the second rotatable shaft to have a first detent position aligned with the retracted position and a second detent position aligned with the deployed position. In yet further embodiments, the actuation mechanism may include one or more tension springs that cause the power adapter to self-actuate between the first detent position and the second detent position.

In other embodiments the actuation mechanism may comprise one or more cantilever springs. One particular embodiment employs a magnetic actuation mechanism positioned within the adapter housing and operatively coupled to rotate the retractable prongs between the retracted position and the deployed position. The magnetic actuation mechanism includes first and second driver magnets spaced a first axial distance apart that interact with first and second driven magnets attached to the first rotatable shaft. The magnetic actuation mechanism is axially displaced by the user from a first position in which the first driver magnet is adjacent to the first driven magnet and the second driver magnet is displaced from the second driven magnet, to a second position in which the second driver magnet is adjacent to the second driven magnet and the first driver magnet is displaced from the first driven magnet. The driver and driven magnets are operatively coupled such that when the magnetic drive mechanism moves from the first position to the second position, the retractable prong is pivoted to the retracted position, and when the magnetic drive mechanism moves from the second position to the first position the retractable prong is pivoted to the deployed position.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Certain embodiments of the present invention relate to electrical power adapters. While the present invention can be useful for a wide variety of electrical power adapters, some embodiments of the invention are particularly useful for electrical power adapters with collapsible prongs, as described in more detail below.

Figure 1:
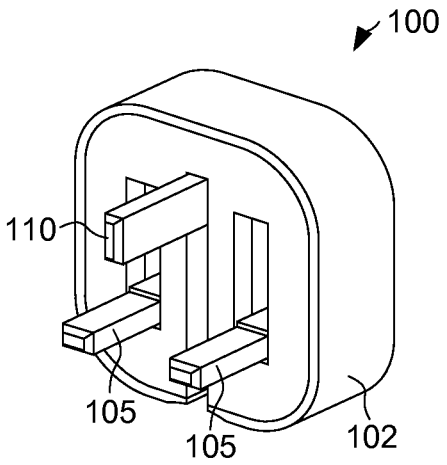
FIG. 1 is a front perspective view of a collapsible power adapter in a deployed position according to an embodiment of the invention.

Many electronic devices such as smart-phones, media players, and tablet computers have electrical power adapters that facilitate battery charging. As an example, a three prong power adapter 100 compatible with the BS1363 (Type G) standard in the United Kingdom is illustrated in FIG. 1. Power adapter 100 has three rectangular prongs forming an isosceles triangle and extending away from housing 102. Line and neutral prongs 105 are approximately 4 mm by 8 mm and 17.7 mm long, on centers spaced 22.2 mm apart. Earth prong 110 is approximately 4 mm by 8 mm and 22.7 mm long. In other embodiments power adapters having prongs of different physical shapes and dimensions may be used.

Figure 2:
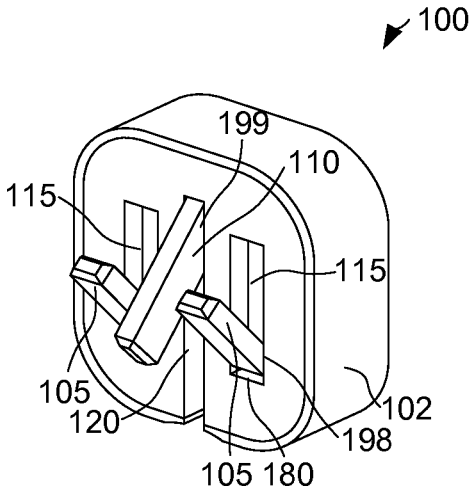
FIG. 2 is a front perspective view of the collapsible power adapter shown in FIG. 1 transitioning between a deployed position and a retracted position.
Figure 3:
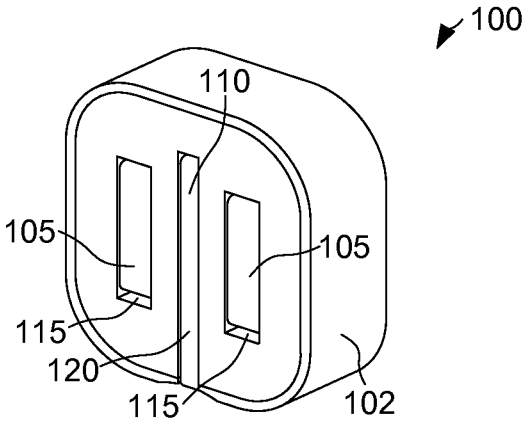
FIG. 3 is a front perspective view of a collapsible power adapter in a retracted position.

In this embodiment, prongs 105, 110 may be rotatably retractable. FIG. 2 illustrates prongs 105, 110 in a partially retracted position. FIG. 3 illustrates prongs 105, 110 in a fully retracted position where they are adjacent housing 102. Further, in FIG. 3, prongs 105, 110 are stowed within line and neutral slots 115 and earth slot 120, respectively. Thus, power adapter 100 has reduced physical size in FIG. 3 where prongs 105, 110 are in the retracted position, rotated approximately 90 degrees, as compared to FIG. 1 where the prongs are in the deployed position. As illustrated in FIG. 2, in some embodiments, pivot point 198 for line and neutral retractable prongs 105 is proximate a first end 180 of line and neutral slots 115 while pivot point 199 for earth prong 110 is proximate an end of earth slot 120 opposite the first end 180 of the line and neutral slots. Thus, in some embodiments, line and neutral prongs 105 may pivot in an opposite direction as ground prong 110. More specifically, as illustrated in FIG. 2, when transitioning from the deployed position to the retracted position, line and neutral prongs 105 may pivot up while ground prong 110 may pivot down.

Figure 4:
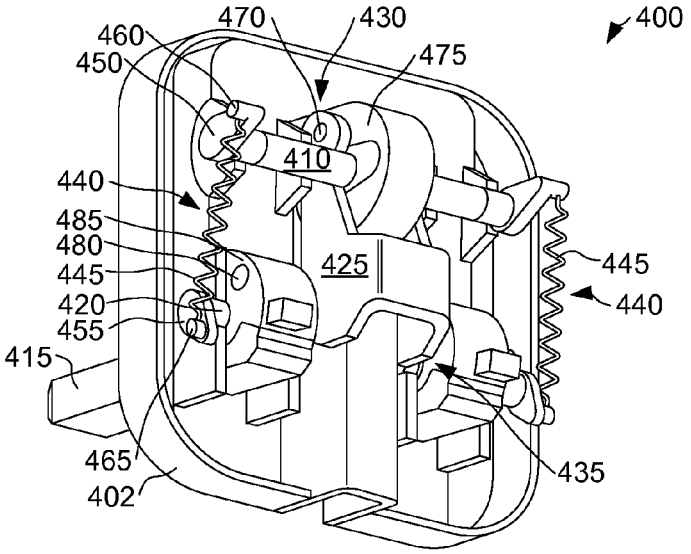
FIG. 4 is a rear perspective view of the collapsible power adapter shown in FIG. 1 having a quadrilateral linkage and a tension spring actuation mechanism in a deployed position with a portion of the housing removed.
Figure 5:
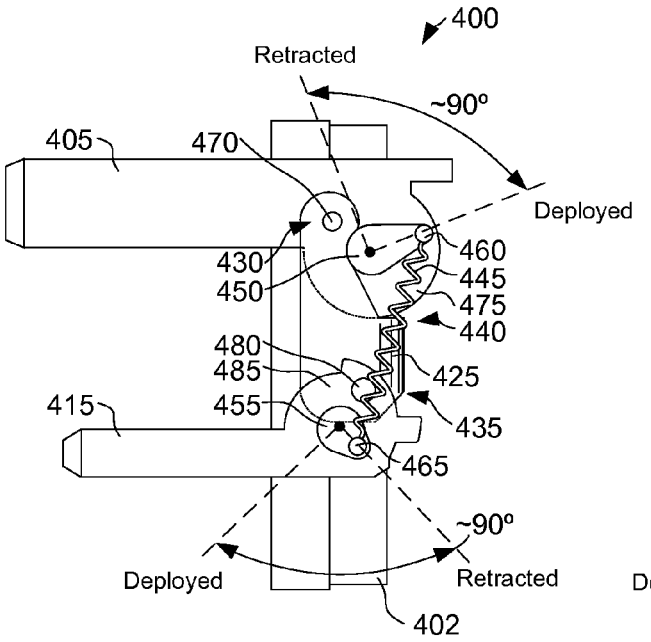
FIG. 5 is a left side plan view of the collapsible power adapter shown in FIG. 4 in a deployed position.
Figure 6:
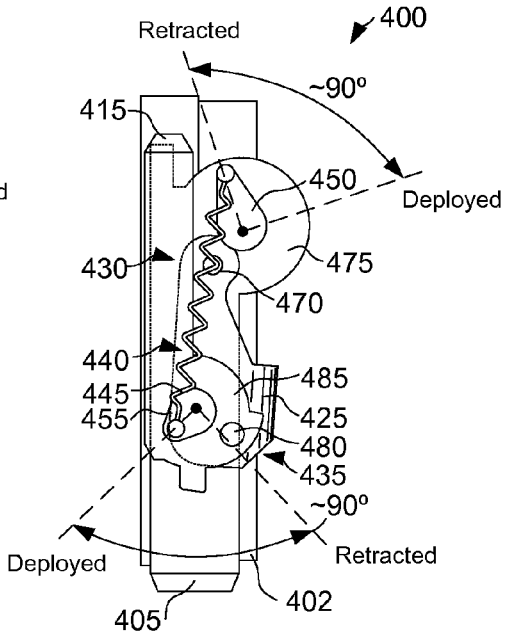
FIG. 6 is a left side plan view of the collapsible power adapter shown in FIG. 4 in a retracted position.

FIG. 4 illustrates a rear isometric view of power adapter 400 with a portion of housing 402 removed, showing the internal construction of an embodiment. FIGS. 5 and 6 show the embodiment of FIG. 4 in the deployed position and the retracted position, respectively. The following discussion will simultaneously reference FIGS. 4 through 6.

Power adapter 400 includes a first retractable prong 405 and a pair of second retractable prongs 415 (only one of which is shown in FIGS. 4-6). Housing 402 can be similar to housing 102 shown in FIGS. 1-3 and may include slots (not shown in FIGS. 4-6) similar to slots 115, 120 to hide prongs 405, 415 in a retracted position as shown in FIGS. 1-3. First retractable prong 405 is coupled to a first rotatable shaft 410 within housing 402 such that the first retractable prong can be pivoted from a retracted position in which the first retractable prong is positioned adjacent to the housing to a deployed position in which the first retractable prong extends away from the housing, and can be inserted into an electrical outlet. Second retractable prong 415 is coupled to a second rotatable shaft 420 within housing 402 such that the second retractable prong can be pivoted from a retracted position in which the second retractable prong is positioned adjacent to the housing, to a deployed position in which the second retractable prong extends away from the housing and can be inserted into an electrical outlet. In some embodiments, second retractable prong 415 may comprise two adjacent prongs (i.e., a pair of retractable prongs) where each second retractable prong may have a separate rotatable shaft (i.e., a pair of second rotatable shafts). In some embodiments the pair of second rotatable shafts may be axially aligned as illustrated in FIGS. 4-6.

A linkage 425 having a first portion 430 connected to first rotatable shaft 410 and second portion 435 connected to second rotatable shaft 420 transfers force such that when first retractable prong 405 is pivoted from the retracted position to the deployed position, second retractable prong 415 is simultaneously pivoted in the opposite direction from the retracted position to the deployed position. In some embodiments, linkage 425 may be coupled to first and second rotatable shafts 410, 420 respectively through portions of first and second retractable prongs 405, 415, respectively. In this embodiment, linkage 425 is a planar quadrilateral configuration formed into a clevis such that it may be attached to two second retractable prongs 415. Linkage 425 will be described in more detail below. Other types of linkages are within the scope of this disclosure and may be employed in other embodiments. In further embodiments linkage 425 may be connected to a pair of second rotatable shafts.

In some embodiments, power adapter 400 may further comprise an actuation mechanism 440 causing first rotatable shaft 410 and second rotatable shaft 420 to have a first detent position aligned with the retracted position and a second detent position aligned with the deployed position. As defined herein, a detent position is a point of relative stability or "equilibrium" in the system where the system resists movement. In one embodiment, actuation mechanism 440 may include one or more tension springs 445 that cause power adapter 400 to be relatively unstable between the first detent position and the second detent position such that first and second retractable prongs 405, 415, respectively, may self-actuate between the two detent positions. That is, when a user rotates first retractable prong 405 from the deployed position towards the retracted position, actuation mechanism 440 may cause first and second retractable prongs 405, 415, respectively to self-actuate (i.e., "snap") to the refracted position. As used herein, self-actuate shall mean that the mechanism is relatively unstable between the first and second detent positions such that when it is in-between the two detent positions it will self-actuate (i.e., move under its own power) towards one or the other points of equilibrium.

Similarly, when a user rotates first retractable prong 405 from the retracted position towards the deployed position, actuation mechanism 440 may cause first and second retractable prongs 405, 415, respectively to self-actuate to the deployed position. Further, actuation mechanism 440 may cause first and second retractable prongs 405, 415, respectively, to be restrained (i.e., in a detent position) in the retracted position and the deployed position such that they must be purposefully moved from the detent positions by a user. In some embodiments, restraining first and second retractable prongs 405, 415, respectively, in the deployed position may enable a user to easily insert and remove power adapter 400 from a receptacle connector. Similarly, restraining first and second retractable prongs 405, 415, respectively, in the retracted position may enable the retractable prongs to remain in the retracted position during transport. In some embodiments, first and second retractable prongs 405, 415, respectively, may have hard stops that stop them from moving beyond the retracted position and/or beyond the deployed position.

As illustrated in FIGS. 4 through 6, tension springs 445 may be connected to first rotatable shaft 410 by first crank 450 and to second rotatable shaft 420 by second crank 455. As illustrated in FIGS. 5 and 6, first crank 450 and second crank 455 may rotate approximately 90 degrees between the retracted position and the deployed position. To create first and second detent positions, first and second cranks 450, 455 may be oriented such that the distance between a first pin 460 and a second pin 465 is shorter in the retracted and deployed positions than it is in between the retracted and deployed positions. That is, tension spring 445 may be stretched more when in between the retracted and deployed positions such that first and second retractable prongs 405, 415, respectively will be relatively unstable between the retracted and deployed positions and will self-actuate between the two positions, forcing the first and second retractable prongs against the hard stops.

As defined herein, the precise position in-between the retracted and deployed positions where the mechanism is bi-stable (i.e., the mechanism is unstable and on the verge of self-actuating to either the retracted or the deployed positions) shall be called the inflection point of the mechanism. Thus, if the mechanism is on the retracted side of the inflection point it will self-actuate towards the retracted position and if it is on the deployed side of the inflection point it will self-actuate towards the deployed position. More specifically, the inflection point is the precise location where the transition from actuating from the retracted position to the deployed position occurs. The inflection point may be designed to be at any location between the retracted and deployed positions. In one embodiment the inflection point may be centered between the retracted and deployed positions (e.g., at a rotation of first crank 450 of 45 degrees). In other embodiments the inflection point may be closer to the retracted position such that the deployed position is more stable and the mechanism doesn't actuate if a user misses the outlet with the plug and moves first and second retractable prongs 405, 415. In one embodiment the inflection point is located between 14 degrees and 44 degrees from the retracted position of first crank 450. In another embodiment the inflection point is located between 24 degrees and 44 degrees from the retracted position. In a further embodiment the inflection point is located between 34 degrees and 44 degrees from the retracted position.

As discussed above, linkage 425 may be a planar quadrilateral linkage. Planar quadrilateral linkages have four rotating joints and four linkage members. As illustrated in FIGS. 5 and 6, first portion 430 of linkage 425 may be coupled to first rotatable shaft 410 with first hub pin 470 to first rotatable shaft hub 475. Similarly, second portion 435 of linkage 425 may be coupled to second rotatable shaft 420 with a second hub pin 480 to second rotatable shaft hub 485. Thus, the four rotating joints are first rotatable shaft 410, first hub pin 470, second rotatable shaft 420 and second hub pin 480.

First hub pin 470 may be axially offset from first rotatable shaft 410 axis of rotation such that first portion 430 of linkage 425 does not interfere with the first rotatable shaft when transitioning between the retracted and the deployed positions. Similarly, second hub pin 480 may be axially offset from second rotatable shaft 420 axis of rotation such that second portion 435 of linkage 425 does not interfere with the second rotatable shaft when transitioning between the retracted and the deployed positions. Thus, the four linkage members are the housing that is disposed between first rotatable shaft 410 and second rotatable shaft 420, the offset between first rotatable shaft 410 and first hub pin 470, the offset between second rotatable shaft 420 and second hub pin 480, and linkage 425.

Second portion 435 of linkage 425 may be formed into a clevis and coupled to a pair of second retractable prongs 415 such the pair of retractable prongs move together. The clevis is a U-shaped member that has holes at the end to accept second hub pin 480. In the embodiment illustrated in FIGS. 4-6 there may be two second hub pins 480, one for each second retractable prong 415. In other embodiments, there may only be a single second hub pin 480 that connects to both second retractable prongs 415. In further embodiments, first portion 430 of linkage 425 may also be formed into a clevis and coupled to a first retractable prong 405 with first rotatable shaft hub 475. In other embodiments, first portion 430 of linkage 425 may not be a clevis and may have only a single member attached to first rotatable shaft hub 475.

Some embodiments and configurations of the power adapters disclosed herein may include either a linkage or an actuation mechanism, or both. Further, some embodiments may employ different linkage and/or actuation mechanisms than those illustrated herein. The different linkage and actuation mechanisms may be used interchangeably and in different combinations as discussed in more detail below.

Figure 7:
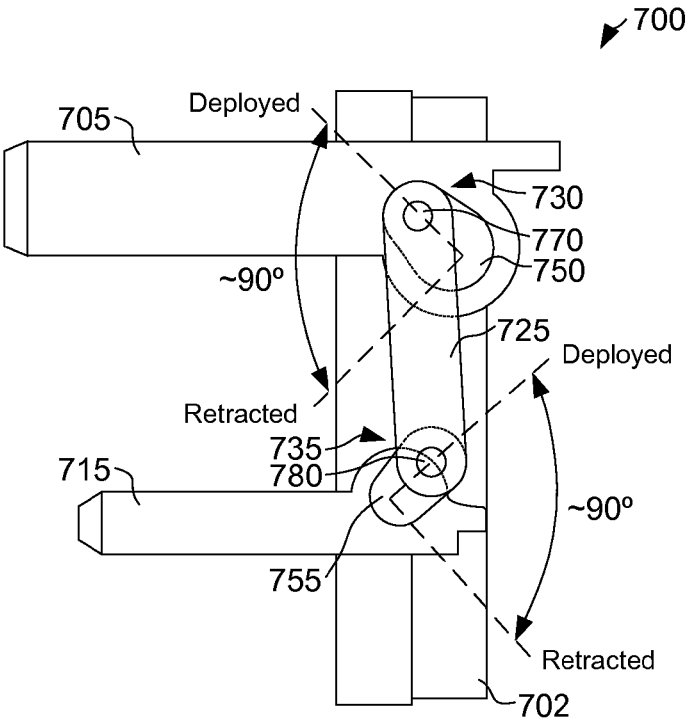
FIG. 7 is a left side plan view of a collapsible power adapter having a quadrilateral linkage in a deployed position according to an embodiment of the invention.
Figure 8:
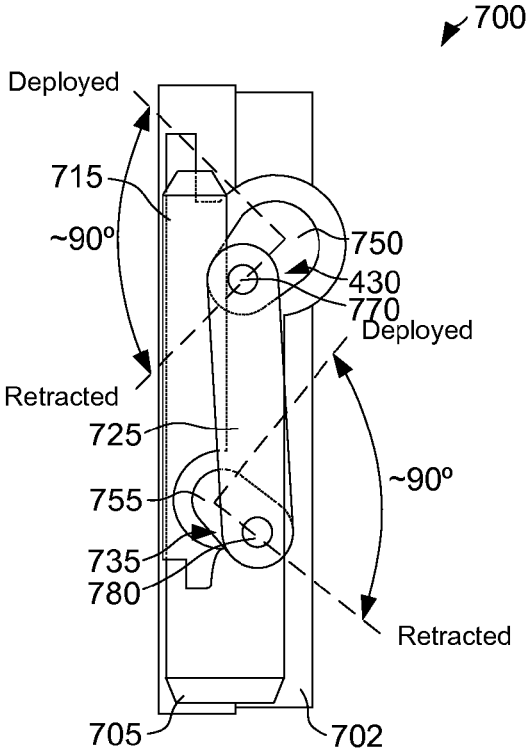
FIG. 8 is a left side plan view of the collapsible power adapter shown in FIG. 7 in a retracted position.

Reference is now made to FIGS. 7 and 8 that illustrate an embodiment of power adapter 700 in the deployed position, and the retracted position, respectively. Power adapter 700 may be similar to power adapter 400 illustrated in FIGS. 4-6. More specifically, power adapter 700 may employ a quadrilateral linkage mechanism having four rotating joints and four linkage members. The linkage mechanism may include a pair of parallel bars instead of using a clevis.

First retractable prong 705 is coupled to a first rotatable shaft (not shown) within housing 702 such that the first retractable prong can be pivoted from a retracted position in which the first retractable prong is positioned adjacent to the housing, to a deployed position in which the first retractable prong extends away from the housing, and can be inserted into an electrical outlet. In some embodiments second retractable prong 715 may comprise two adjacent prongs. Second retractable prong 715 is coupled to a second rotatable shaft (not shown) within housing 702 such that the second retractable prong can be pivoted from a retracted position in which the second retractable prong is positioned adjacent to the housing, to a deployed position in which the second retractable prong extends away from the housing, and can be inserted into an electrical outlet.

Linkage 725 has a first portion 730 connected to first rotatable shaft (not shown) and second portion 735 connected to second rotatable shaft (not shown). More specifically, first portion 730 of linkage 725 may be coupled to first rotatable shaft (not shown) with a first pin 770 to first crank 750. Similarly, second portion 735 of linkage 725 may be coupled to second rotatable shaft (not shown) with a second pin 780 to second crank 755. Linkage 725 transfers force such that when first retractable prong 705 is pivoted from the retracted position to the deployed position, second retractable prong 715 is simultaneously pivoted from the retracted position to the deployed position. In this embodiment linkage 725 is a planar quadrilateral linkage with a dual-bar configuration such that it may be attached to a pair of second retractable prongs 415. More specifically, in some embodiments there may be two linkages 725 such that two second retractable prongs 715 may be actuated. However, other types of linkages are within the scope of this disclosure and may be employed in further embodiments.

As illustrated, first crank 750 and second crank 755 may rotate approximately 90 degrees between the retracted position and the deployed position. First pin 770 may be axially offset from first rotatable shaft (not shown) such that first portion 730 of linkage 725 does not interfere with the first rotatable shaft when transitioning between the retracted and the deployed positions.

Similarly, second pin 780 may be axially offset from second rotatable shaft (not shown) axis of rotation such that second portion 735 of linkage 725 does not interfere with the second rotatable shaft when transitioning between the retracted and the deployed positions. Second portion 735 of linkage 725 may be similarly connected to a pair of second retractable prongs 715 such the pair of retractable prongs move together.

Figure 9:
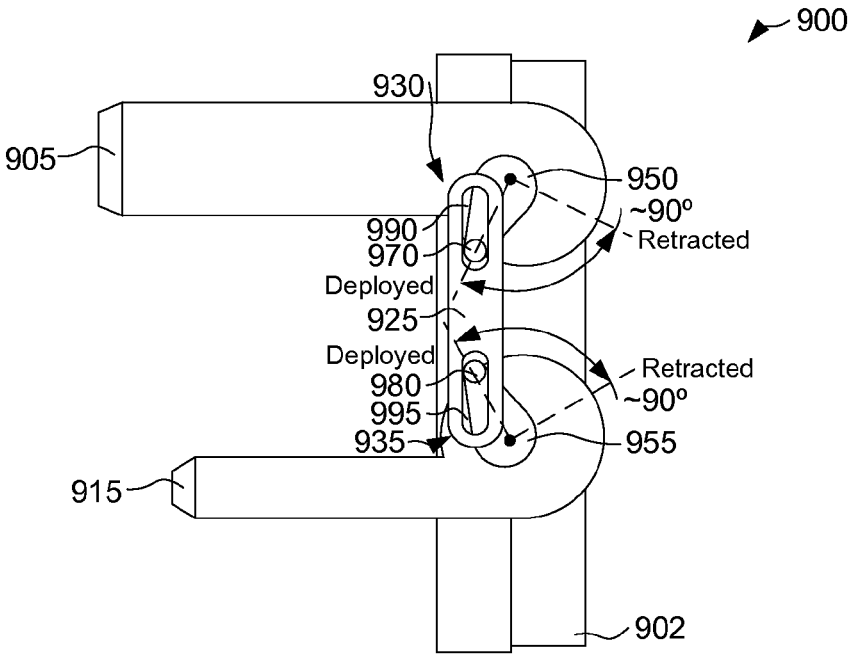
FIG. 9 is a left side plan view of a collapsible power adapter having a pin and slot linkage in a deployed position according to an embodiment of the invention.
Figure 10:
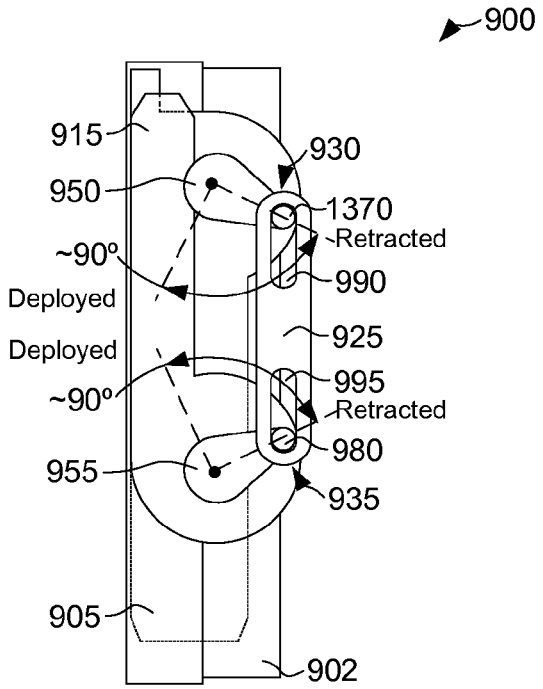
FIG. 10 is a left side plan view of the collapsible power adapter shown in FIG. 9 in a retracted position.

FIGS. 9 and 10 show an embodiment of power adapter 900, in the deployed position and the retracted position, respectively. The following discussion will simultaneously reference FIGS. 9 and 10. Power adapter 900 has a pin and slot linkage mechanism 925 that may be used in some embodiments.

Power adapter 900 includes a first retractable prong 905 and a pair of second retractable prongs 915 (only one of which is shown in FIGS. 9-10). Housing 902 can be similar to housing 102 shown in FIGS. 1-3 and may include slots (not shown in FIGS. 4-6) similar to slots 115, 120 to hide prongs 905, 915 in a retracted position as shown in FIGS. 1-3. First retractable prong 905 is coupled to a first rotatable shaft (not shown) within housing 902 such that the first retractable prong can be pivoted from a retracted position in which the first retractable prong is positioned adjacent to the housing, to a deployed position in which the first retractable prong extends away from the housing, and can be inserted into an electrical outlet. In some embodiments second retractable prong 915 may comprise two adjacent prongs. Second retractable prong 915 is coupled to a second rotatable shaft (not shown) within housing 902 such that the second retractable prong can be pivoted from a retracted position in which the second retractable prong is positioned adjacent to the housing, to a deployed position in which the second retractable prong extends away from the housing, and can be inserted into an electrical outlet.

Linkage 925 has a first portion 930 connected to first rotatable shaft (not shown) and second portion 935 connected to second rotatable shaft (not shown) and transfers force such that when first retractable prong 905 is pivoted from the retracted position to the deployed position, second retractable prong 915 is simultaneously pivoted from the retracted position to the deployed position. In this embodiment linkage 925 is a pin and slot type with a dual-bar configuration such that it may be attached to a pair of second retractable prongs 915. More specifically, there may be two linkages 925 such that two second retractable prongs 915 may be actuated. However, other types of linkages are within the scope of this disclosure and may be employed in other embodiments.

First portion 930 of linkage 925 may be coupled to first rotatable shaft (not shown) with a first pin 970 on a first crank 950. First pin 970 may be disposed in first slot 990 of linkage 925. Similarly, second portion 935 of linkage 925 may be coupled to second rotatable shaft (not shown) with a second pin 980 on a second crank 955. Second pin 980 may be disposed in second slot 995 of linkage 925. As illustrated, first crank 950 and second crank 955 may rotate approximately 90 degrees between the retracted position and the deployed position. As further illustrated in FIG. 9, linkage 925 may be in a first position (shown in FIG. 9 as a "left-most" position) where first and second pins 970, 980, respectively slide in first and second slots, 990, 995, respectively forcing first and second retractable prongs 905, 915, respectively to be in a deployed position. As illustrated in FIG. 10, linkage 925 may be in a second position (shown in FIG. 10 as a "right-most" position) where first and second pins 970, 980, respectively slide in first and second slots, 990, 995, respectively forcing first and second retractable prongs 905, 915, respectively to be in a retracted position. In some embodiments, linkage 925 may have one or more guides that maintain the linkage in an approximately vertical alignment and don't allow the beam to rotate in plane, as it's illustrated in FIGS. 9 and 10. More specifically, in some embodiments linkage 925 may be constrained to left and right translation only.

Figure 11:
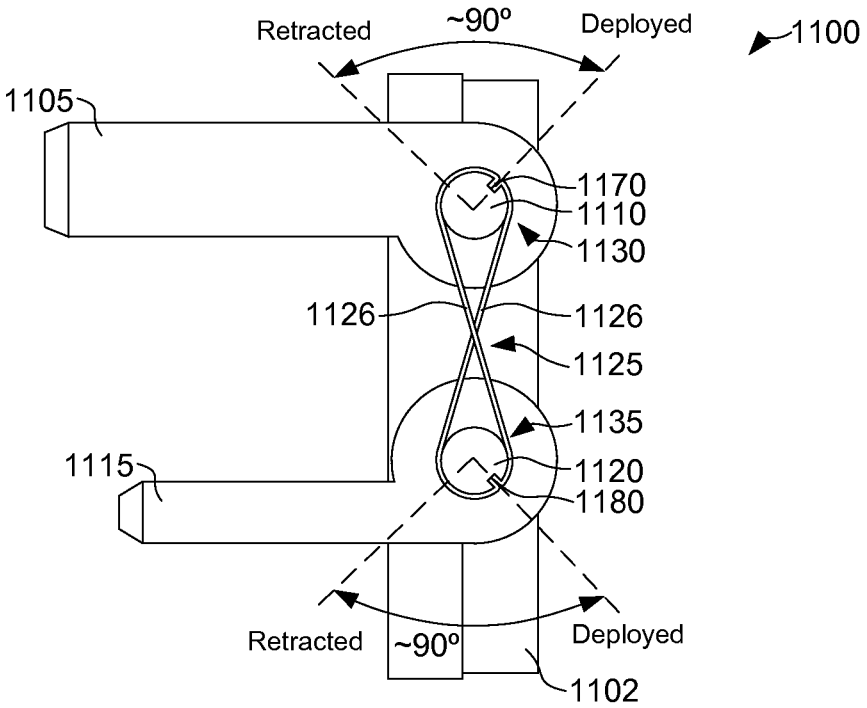
FIG. 11 is a left side plan view of a collapsible power adapter having a flexible belt linkage in a deployed position according to an embodiment of the invention.
Figure 12:
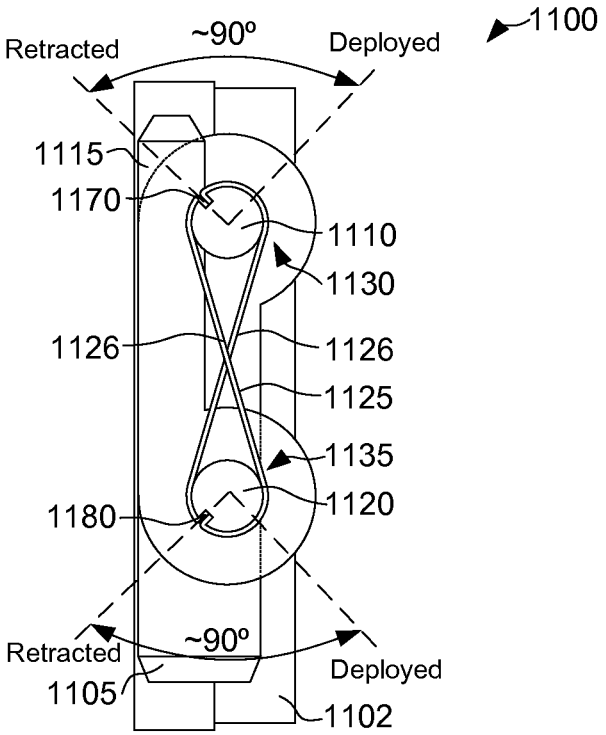
FIG. 12 is a left side plan view of the collapsible power adapter shown in FIG. 11 in a retracted position.

FIGS. 11 and 12 illustrate an embodiment of power adapter 1100, in the deployed position and the retracted position, respectively. The following discussion will simultaneously reference FIGS. 11 and 12. Power adapter 1100 has a flexible band linkage 1125 mechanism that may be used in some embodiments.

Power adapter 1100 includes a first retractable prong 1105 and a pair of second retractable prongs 1115 (only one of which is shown in FIGS. 11-12). Housing 1102 can be similar to housing 102 shown in FIGS. 1-3 and may include slots (not shown in FIGS. 11-12) similar to slots 115, 120 to hide prongs 1105, 1115 in a retracted position as shown in FIGS. 1-3. First retractable prong 1105 is coupled to a first rotatable shaft 1110 within housing 1102 such that the first retractable prong can be pivoted from a retracted position in which the first retractable prong is positioned adjacent to the housing, to a deployed position in which the first retractable prong extends away from the housing, and can be inserted into an electrical outlet. In some embodiments second retractable prong 1115 may comprise two adjacent prongs. Second retractable prong 1115 is coupled to a second rotatable shaft 1120 within housing 1102 such that the second retractable prong can be pivoted from a retracted position in which the second retractable prong is positioned adjacent to the housing, to a deployed position in which the second retractable prong extends away from the housing, and can be inserted into an electrical outlet.

Linkage 1125 has a first portion 1130 connected to first rotatable shaft 1110 and a second portion 1135 connected to second rotatable shaft 1120 and is configured to transfer force such that when first retractable prong 1105 is pivoted from the retracted position to the deployed position, second retractable prong 1115 is simultaneously pivoted in the opposite direction from the retracted position to the deployed position.

In some embodiments, linkage 1125 may comprise one or more flexible bands 1126. First portion 1130 of linkage 1125 may be coupled to first rotatable shaft 1110 with first retention feature 1170. Similarly, second portion 1135 of linkage 1125 may be coupled to second rotatable shaft 1120 with second retention feature 1180. First and second retention features 1170, 1180, respectively may be slots in first and second rotatable shafts 1110, 1120, respectively. Flexible bands 1126 may be secured with a wedge, a screw, adhesive or any other means. Flexible bands 1126 may be partially wrapped around first and second rotatable shafts 1110, 1120, respectively. In other embodiments, there may only be one flexible band 1126 with no retention features. As illustrated, first rotatable shaft 1110 and second rotatable shaft 1120 may rotate approximately 90 degrees between the retracted position and the deployed position. As further illustrated in FIG. 11, linkage 1125 may be in a first position such that when first retractable prong is moved downwards, first rotatable shaft 1110 rotates counterclockwise. Flexible band 1126 may be configured to reverse the rotation direction causing second rotatable shaft 1120 to rotate clockwise and second retractable prong 1115 to retract. That is, flexible band 1126 may be formed in a figure-eight shape as illustrated, as opposed to an elongated O-shape shape which would not reverse the rotation direction.

Figure 13:
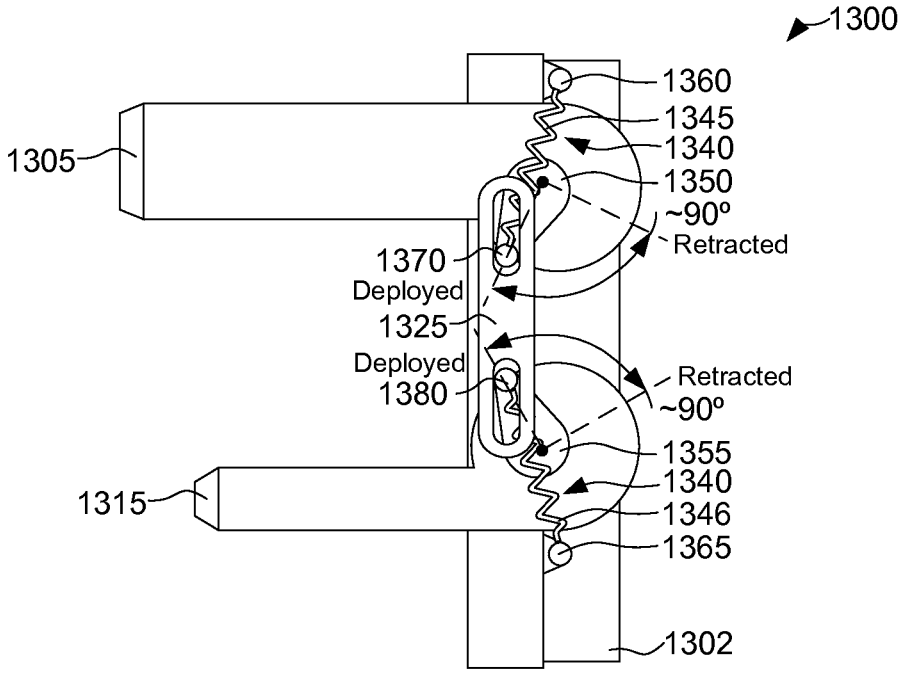
FIG. 13 is a left side plan view of a collapsible power adapter having a pin and slot linkage and a tension spring actuation mechanism in a deployed position according to an embodiment of the invention.
Figure 14:
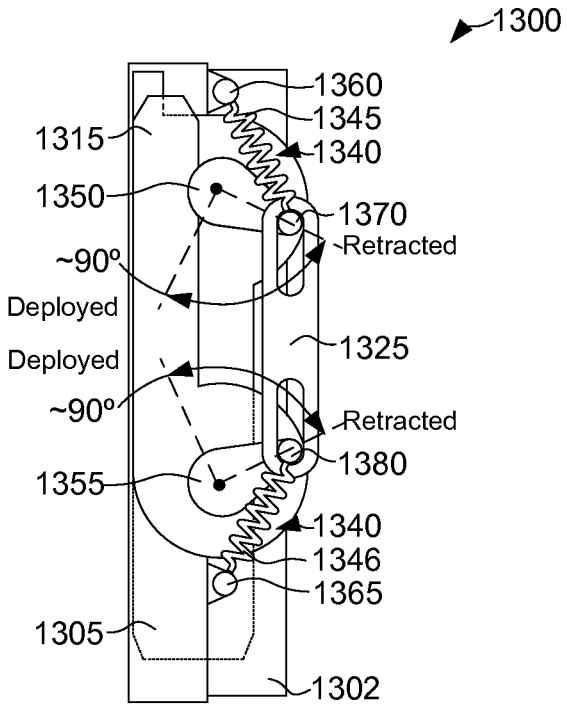
FIG. 14 is a left side plan view of the collapsible power adapter shown in FIG. 13 in a retracted position.

FIGS. 13 and 14 show an embodiment of power adapter 1300, in the deployed position and the retracted position, respectively. The following discussion will simultaneously reference FIGS. 13 and 14. Power adapter 1300 has a tension spring actuation mechanism 1340 that may be used in some embodiments.

Power adapter 1300 includes a first retractable prong 1305 and a pair of second retractable prongs 1315 (only one of which is shown in FIGS. 13-14). Housing 1302 can be similar to housing 102 shown in FIGS. 1-3 and may include slots (not shown in FIGS. 13-14) similar to slots 115, 120 to hide prongs 1305, 1315 in a retracted position as shown in FIGS. 1-3. Linkage 1325 may be similar to the pin and slot linkage mechanism employed in FIGS. 9 and 10. However, in this embodiment an actuation mechanism 1340 may also be employed, causing first rotatable shaft (not shown) and second rotatable shaft (not shown) to have a first detent position aligned with the refracted position and a second detent position aligned with the deployed position. In further embodiments, actuation mechanism 1340 may include first and second tension springs 1345, 1346, respectively, that cause power adapter 1300 to be relatively unstable between the first detent position and the second detent position such that the first and second retractable prongs 1305, 1315, respectively, may self-actuate between the two detent positions. That is, when a user rotates first retractable prong 1305 from the deployed position towards the retracted position, actuation mechanism 1340 may cause first retractable prong 1305 and second retractable prong 1315 to self-actuate (i.e., "snap") to the retracted position.

Similarly, when a user rotates first retractable prong 1305 from the retracted position towards the deployed position, actuation mechanism 1340 may cause first retractable prong 1305 and second retractable prong 1315 to self-actuate to the deployed position. Further, actuation mechanism 1340 may cause first and second retractable prongs 1305, 1315, respectively, to be restrained in the retracted position and the deployed position such that they must be purposefully moved from the detent positions by a user. In some embodiments, restraining first and second retractable prongs 1305, 1315, respectively, in the deployed position may enable a user to easily insert and remove power adapter 1300 from a receptacle connector. Similarly, restraining first and second retractable prongs 1305, 1315, respectively, in the retracted position may enable the retractable prongs to remain in the retracted position during transport. In some embodiments, first and second retractable prongs 1305, 1315, respectively, may have hard stops that do not allow them to move beyond the retracted and/or the deployed positions.

As illustrated in FIGS. 13 and 14, first tension spring 1345 may be connected between a first pin 1370 and a first spring attachment point 1360. First pin 1370 may be mounted on first crank 1350 and coupled to first rotatable shaft (not shown). Similarly, second tension spring 1346 may be connected between a second pin 1380 and a second spring attachment point 1365. Second pin 1380 may be mounted on second crank 1355 and coupled to second rotatable shaft (not shown). As further illustrated, first crank 1350 and second crank 1355 may rotate approximately 90 degrees between the retracted position and the deployed position. To create first and second detent positions, first crank 1350 may be oriented such that the distance between first pin 1370 and first spring attachment point 1360 is shorter in the retracted and deployed positions than it is in between the retracted and deployed positions.

Similarly, second crank 1355 may be oriented such that the distance between second pin 1380 and second spring attachment point 1365 is shorter in the retracted and deployed positions than it is in between the retracted and deployed positions. That is, first and second tension springs 1345, 1346, respectively, may be stretched more when in between the retracted and deployed positions such that first and second retractable prongs 1305, 1315, respectively will be relatively unstable between the retracted and deployed positions and will self-actuate between the two positions, forcing the first and second retractable prongs against hard stops. More specifically, the retracted and deployed positions may be "over center" positions for first and second cranks 1350, 1355, respectively, where the first and second cranks will self-actuate to either the retracted or the deployed position and be held there by the tension in first and second tension springs 1345, 1346, respectively. In some embodiments, linkage 1325 may have one or more guides that maintain the linkage in an approximately vertical alignment and don't allow the beam to rotate in plane, as it's illustrated in FIGS. 13 and 14. More specifically, in some embodiments linkage 1325 may be constrained to left and right translation only.

As discussed above, the inflection point for the mechanism may be designed to be at any location between the retracted and deployed positions. In one embodiment the inflection point may be centered between the retracted and deployed positions (e.g., at a rotation of first crank 1350 of 45 degrees). In other embodiments the inflection point may be closer to the retracted position. In one embodiment the inflection point is located between 14 degrees and 44 degrees from the retracted position of first crank 1350. In another embodiment the inflection point is located between 24 degrees and 44 degrees from the retracted position. In a further embodiment the inflection point is located between 34 degrees and 44 degrees from the retracted position.

Figure 15:
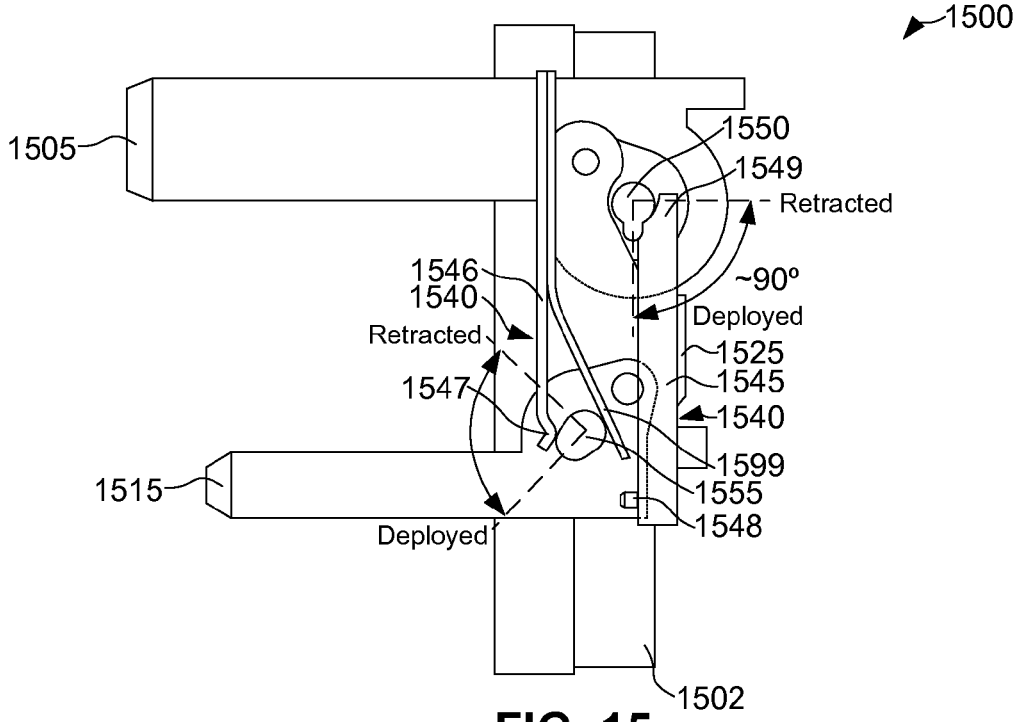
FIG. 15 is a left side plan view of a collapsible power adapter having a quadrilateral linkage and a cantilever spring actuation mechanism in a deployed position according to an embodiment of the invention.
Figure 16:
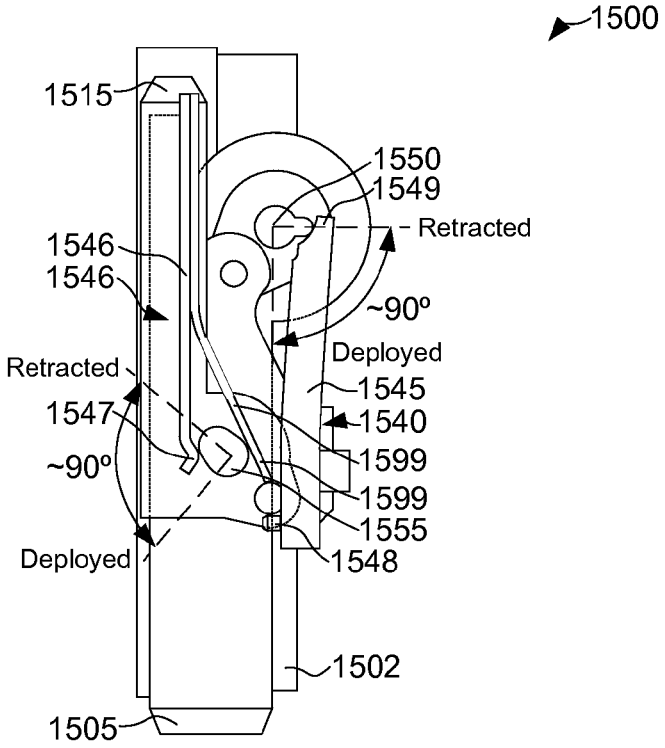
FIG. 16 is a left side plan view of the collapsible power adapter shown in FIG. 15 in a retracted position.

FIGS. 15 and 16 show an embodiment of power adapter 1500, in the deployed position and the retracted position, respectively. The following discussion will simultaneously reference FIGS. 15 and 16. Power adapter 1500 has a cantilever spring actuation mechanism 1540 that may be used in some embodiments.

Power adapter 1500 includes a first retractable prong 1505 and a pair of second retractable prongs 1515 (only one of which is shown in FIGS. 15-16). Housing 1502 can be similar to housing 102 shown in FIGS. 1-3 and may include slots (not shown in FIGS. 15-16) similar to slots 115, 120 to hide prongs 1505, 1515 in a retracted position as shown in FIGS. 1-3. Linkage 1525 may be similar to the planar quadrilateral clevis-type linkage mechanism employed in FIGS. 4 through 6. However, in this embodiment a cantilever spring actuation mechanism 1540 may be employed, causing first rotatable shaft (not shown) and second rotatable shaft (not shown) to have a first detent position aligned with the retracted position and a second detent position aligned with the deployed position. In further embodiments, actuation mechanism 1540 may include first and second cantilever springs 1545, 1546, respectively, that cause power adapter 1500 to be relatively unstable between the first detent position and the second detent position such that first and second retractable prongs 1505, 1515, respectively, may self-actuate between the two detent positions. That is, when a user rotates first retractable prong 1505 from the deployed position towards the retracted position, actuation mechanism 1540 may cause first retractable prong 1505 and second retractable prong 1515 to self-actuate (i.e., "snap") to the retracted position.

Similarly, when a user rotates first retractable prong 1505 from the retracted position towards the deployed position, actuation mechanism 1540 may cause first retractable prong 1505 and second retractable prong 1515 to self-actuate to the deployed position. Further, actuation mechanism 1540 may cause first and second retractable prongs 1505, 1515, respectively, to be restrained (i.e., in a detent position) in the retracted position and the deployed position such that they must be purposefully moved from the positions by a user. In some embodiments, restraining first and second retractable prongs 1505, 1515, respectively, in the deployed position may enable a user to easily insert and remove power adapter 1500 from a receptacle connector. Similarly, restraining first and second retractable prongs 1505, 1515, respectively, in the retracted position may enable the retractable prongs to remain in the retracted position during transport. In some embodiments, first and second retractable prongs 1505, 1515, respectively, may have hard stops that that do not allow them to move beyond the retracted and/or the deployed positions.

As illustrated in FIGS. 15 and 16, first cantilever spring 1545 may be have an attachment end 1548 and an opposite end 1549 placed against first cam 1550 such that first retractable prong 1505 is restrained in the deployed position. Further, when transitioning to the retracted position (see FIG. 16) first cantilever spring 1545 may be deflected, applying a resistive force against first cam 1550. Thus, when transitioning from the retracted position to the deployed position, first cantilever spring 1545 may self-actuate when it gets near the deployed position, "snapping" first and second retractable prongs 1505, 1515, respectively into the deployed position.

As further illustrated, second cantilever spring 1546 may be placed against second cam 1555 such that second retractable prong 1515 is restrained in the deployed and retracted positions. Second cantilever spring 1546 may have a discontinuity 1547 that interacts with second cam 1555 such that when second cam is in the deployed or retracted position, the second cam is restrained (i.e., in a detent). As further illustrated, first cam 1550 and second cam 1555 may rotate approximately 90 degrees between the retracted position and the deployed position.

In further embodiments, power adapter 1500 may be equipped with one or more electrical contacts 1599 that conduct through first or second shafts (not shown). Electrical contact 1599 may be preloaded against second shaft (not shown) such that the electrical contact is always in contact with the second shaft when transitioning between the deployed and retracted positions. Second shaft and second retractable prong 1505 may be made of electrically conductive materials that allow current to pass through electrical contact 1599 to second retractable prong 1515. In some embodiments there may be a pair of second retractable prongs 1515 and each may have a separate electrical contact. Similarly, an electrical contact may be used for first shaft (not shown) and first retractable prong 1505.

Figure 17:
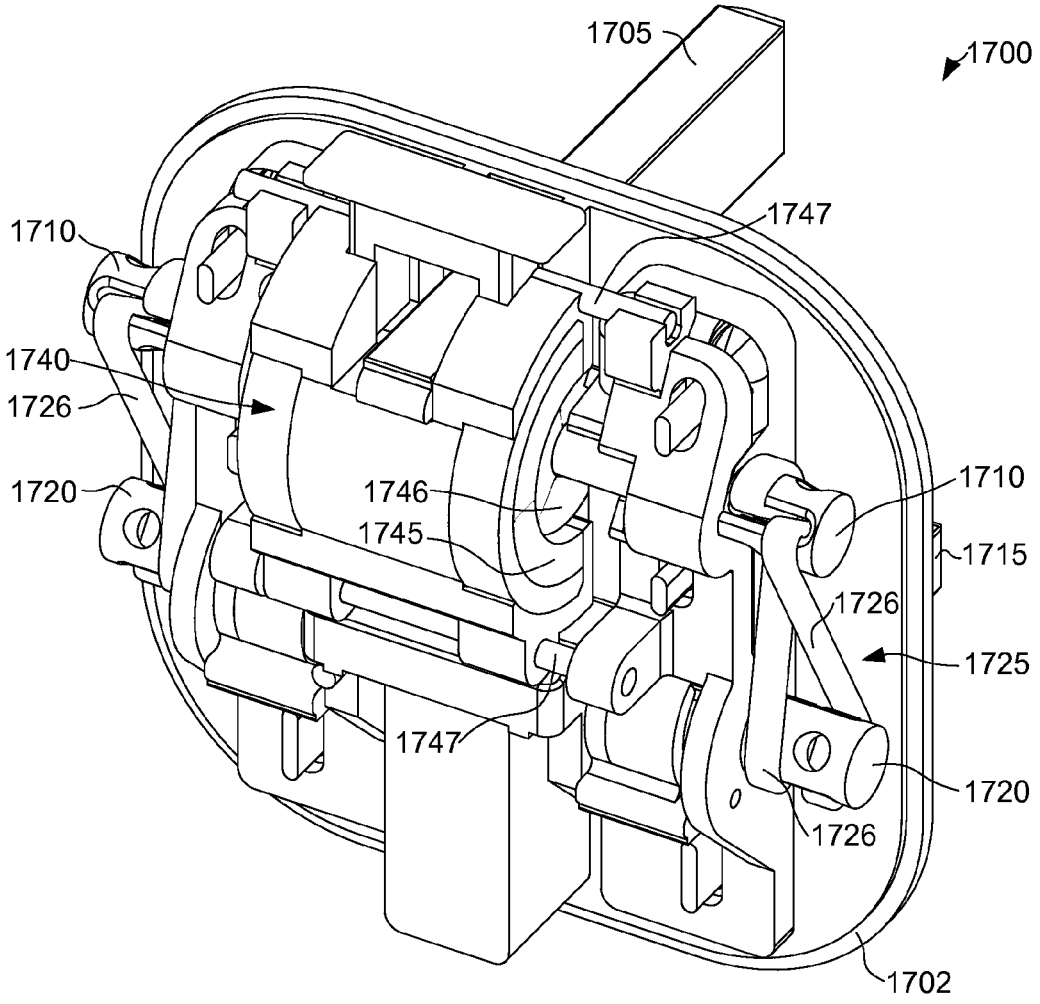
FIG. 17 is a right side perspective view of a collapsible power adapter having a flexible belt linkage and a magnetic actuation mechanism in a deployed position according to an embodiment of the invention.

FIG. 17 shows an embodiment of power adapter 1700, in the deployed position with a portion of housing 1702 removed, showing the internal construction. Power adapter 1700 has a magnetic actuation mechanism 1740 that may be used in some embodiments.

First retractable prong 1705 is coupled to first rotatable shaft 1710 within housing 1702 such that the first retractable prong can be pivoted from a retracted position to a deployed position. Magnetic actuation mechanism 1740 is positioned within housing 1702 and is operatively coupled to rotate first retractable prong 1705 between the retracted position and the deployed position. Magnetic actuation mechanism 1740 includes a first driver magnet 1745 and a second driver magnet (not shown in FIG. 17). A first driven magnet 1746 and a second driven magnet (not shown in FIG. 17) are attached to first rotatable shaft 1710.

An actuator (not shown) such as a depressible button or a slide, for example, may be operatively coupled to magnetic actuation mechanism 1740 to axially move the magnetic drive mechanism from a first position in which first driver magnet 1745 is adjacent first driven magnet 1746 and second driver magnet (not shown in FIG. 17) is displaced from second driven magnet (not shown in FIG. 17), to a second position in which the second driver magnet (not shown in FIG. 17) is adjacent to the second driven magnet (not shown in FIG. 17) and the first driver magnet is displaced from the first driven magnet. These configurations and others are illustrated in greater detail in U.S. patent application Ser. No. 14/260,090. Magnetic actuation mechanism 1740 may have one or more slides 1747 that enable the actuation mechanism to move in a rectilinear motion without rotating. Magnetic actuation mechanism 1740 may be magnetically coupled to first rotatable shaft 1710 such that when the magnetic actuation mechanism moves from the first position to the second position, first retractable prong 1705 is pivoted to the retracted position and when the magnetic actuation mechanism moves from the second position to the first position the first retractable prong is pivoted to the deployed position. Magnetic actuation mechanism 1740 is further described in U.S. patent application Ser. No. 14/260,090 filed on Apr. 23, 2014 and is herein incorporated by reference in its entirety.

FIG. 17 also illustrates first rotatable shaft 1710 operably coupled to second rotatable shaft 1720 with a flexible belt linkage 1725, similar to that illustrated in FIGS. 11 and 12. One or more flexible belts 1726 transfer rotational motion from first rotatable shaft 1710 to second rotatable shaft 1720, such that when first retractable prong 1705 moves between the retracted position and the deployed position, second retractable prong 1715 similarly moves between the retracted position and the deployed position. As illustrated, first rotatable shaft 1710 and second rotatable shaft 1720 may rotate approximately 90 degrees between the retracted position and the deployed position.

Figure 18:
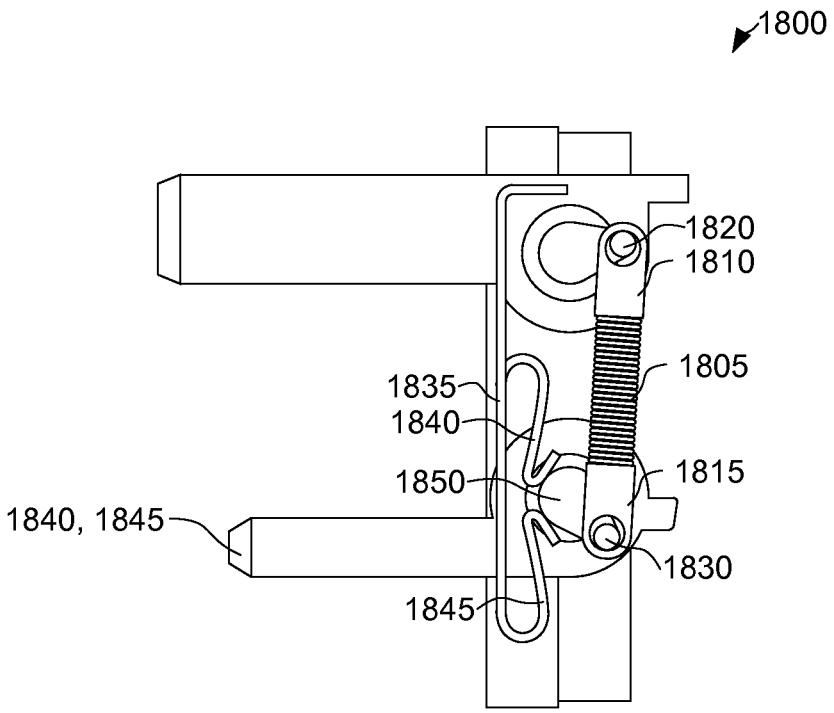
FIG. 18 is a left side plan view of a collapsible power adapter having a modified tension spring and dual electrical contacts according to an embodiment of the invention.

Reference is now made to FIG. 18 that illustrates an embodiment of power adapter 1800 in the deployed position. Power adapter 1800 may be similar to power adapter 400 illustrated in FIGS. 4-6. More specifically, power adapter 1800 may employ a tension spring mechanism to actuate the power adapter. However, in this embodiment, tension spring 1805 may have a first end cap 1810 and a second end cap 1815. End caps 1810, 1815 may have apertures formed to receive first pin 1820 and second pin 1830, respectively. In one embodiment, end caps 1810, 1815 may be formed from a plastic material. Further, in this embodiment an electrical contact 1835 may be used to form an electrical connection to one or more of second retractable prongs 405, 415. Electrical contact 1835 may have one or more spring arms 1840, 1845 that are held in physical contact with rotatable shaft 1850 forming an electrical connection to one or more of second retractable prongs 405, 415. In some embodiments, electrical contact 1835 may be made from a metal or metal alloy that may be plated with one or more metal layers.

The above description discussed four different linkage mechanisms (i.e., quadrilateral with clevis, quadrilateral with dual bar, pin and slot, flexible belt) and three different actuation mechanisms (i.e., tension springs, cantilever springs, magnetic). While power adapter 400 that included the quadrilateral with a clevis linkage mechanism was illustrated with the tension spring actuator, in other embodiments power adapter 400 could include either a cantilever spring actuator or a magnetic actuation as described with respect to FIGS. 15-6 and FIG. 17, respectively. Similarly, power adapter 700 that included the quadrilateral dual bar linkage mechanism could include either a tension spring actuator, a cantilever spring actuator or a magnetic actuation as described with respect to FIGS. 4-6, FIGS. 15-6 and FIG. 17, respectively. Similarly, power adapter 900 that included the pin and slot linkage mechanism could include either a tension spring actuator, a cantilever spring actuator or a magnetic actuation as described with respect to FIGS. 4-6, FIGS. 15-6 and FIG. 17, respectively. Similarly, power adapter 1100 that included the flexible belt linkage mechanism could include either a tension spring actuator, a cantilever spring actuator or a magnetic actuation as described with respect to FIGS. 4-6, FIGS. 15-6 and FIG. 17, respectively.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. A power adapter comprising:

an adapter housing;

a first retractable prong coupled to a first rotatable shaft within the housing such that the first retractable prong can be pivoted from a retracted position in which the first retractable prong is positioned adjacent to the housing, to a deployed position in which the first retractable prong extends away from the housing, and can be inserted into an electrical outlet;

a second retractable prong coupled to a second rotatable shaft within the housing such that the second retractable prong can be pivoted from a retracted position in which the second retractable prong is positioned adjacent to the housing, to a deployed position in which the second retractable prong extends away from the housing, and can be inserted into an electrical outlet;

a linkage connected to the first rotatable shaft and to the second rotatable shaft such that when the first retractable prong is pivoted from the retracted position to the deployed position, the second retractable prong is simultaneously pivoted from the retracted position to the deployed position;

a first crank connected to the first rotatable shaft and a second crank connected to the second rotatable shaft; and one or more springs connected to the first and the second cranks.

2. The power adapter of claim 1 wherein the linkage is a planar quadrilateral configuration.

3. The power adapter of claim 1 wherein the linkage is a planar quadrilateral configuration formed into a clevis.

4. The power adapter of claim 1 wherein the linkage includes one or more flexible belts.

5. The power adapter of claim 1 wherein the first rotatable shaft and the second rotatable shaft have a first detent position aligned with the retracted position and a second detent position aligned with the deployed position.

6. The power adapter of claim 5 wherein the one or more springs includes a tension spring.

7. The power adapter of claim 1 wherein the first crank and the second crank rotate approximately 90 degrees between the retracted position and the deployed position.

8. The power adapter of claim 1 wherein the first crank and the second crank are oriented such that a distance between a first pin disposed in the first crank and a second pin disposed in the second crank is shorter in the retracted and deployed positions than it is when the power adapter is at an inflection point between the retracted and deployed positions.

9. The power adapter of claim 1 wherein an electrical contact is preloaded against the second shaft such that the electrical contact is always in contact with the second shaft when the power adapter transitions between the deployed and retracted positions.

10. A collapsible power adapter comprising:

a housing;

a first retractable prong configured to rotate about a first shaft and a pair of second retractable prongs configured to rotate about a second shaft, wherein the first and the second shafts are affixed to the housing;

a linkage coupling the first retractable prong to the pair of second retractable prongs such that when the first retractable prong is rotated towards the housing the pair of second retractable prongs simultaneously rotate towards the housing in an opposite direction of the first retractable prong; and an actuation mechanism coupled to the first retractable prong or the pair of second retractable prongs such that the first retractable prong or the pair of second retractable prongs self-actuate to a retracted position or a deployed position;

wherein the first shaft has a first crank with a first tension spring attachment point and the second shaft has a second crank with a second tension spring attachment point.

11. The collapsible power adapter of claim 10 wherein the actuation mechanism includes one or more tension springs.

12. The collapsible power adapter of claim 10 wherein first and second cranks are oriented such that a distance between the first crank spring attachment point and the second crank spring attachment point is shorter in the retracted and deployed positions than it is when the power adapter is at an inflection point between the retracted and deployed positions.

13. The power adapter of claim 10 wherein the linkage is a planar quadrilateral configuration.

14. The power adapter of claim 10 wherein the linkage is a planar quadrilateral configuration formed into a clevis.

15. The power adapter of claim 10 wherein an electrical contact is preloaded against the second shaft such that the electrical contact is always in contact with the second shaft when the power adapter transitions between the deployed and retracted positions.

16. A power adapter comprising:

an adapter housing;

a first retractable prong coupled to a first rotatable shaft hub within the housing such that the first retractable prong can be pivoted from a retracted position in which the first retractable prong is positioned adjacent to the housing, to a deployed position in which the first retractable prong extends away from the housing, and can be inserted into an electrical outlet;

a second retractable prong coupled to a second rotatable shaft hub within the housing such that the second retractable prong can be pivoted from a retracted position in which the second retractable prong is positioned adjacent to the housing, to a deployed position in which the second retractable prong extends away from the housing, and can be inserted into an electrical outlet; and a linkage connected to the first rotatable shaft hub with a first pin that is axially offset from a first rotatable shaft axis and connected to the second rotatable shaft hub with a second pin that is axially offset from a second rotatable shaft axis such that when the first retractable prong is pivoted from the retracted position to the deployed position, the second retractable prong is simultaneously pivoted from the retracted position to the deployed position;

a first crank connected to the first rotatable shaft hub and a second crank connected to the second rotatable shaft hub; and a tension spring connected between the first and the second cranks.

17. The power adapter of claim 16 further comprising an actuation mechanism causing the first rotatable shaft and the second rotatable shaft to have a first detent position aligned with the retracted position and a second detent position aligned with the deployed position.

18. The power adapter of claim 16 wherein the first crank and the second crank are oriented such that a distance between a first pin disposed in the first crank and a second pin disposed in the second crank is shorter in the retracted and deployed positions than it is when the power adapter is at an inflection point between the retracted and deployed positions, and the tension spring is connected between the first and second pins.

19. The power adapter of claim 16 wherein the linkage is a planar quadrilateral configuration.

20. The power adapter of claim 16 wherein the linkage is a planar quadrilateral configuration formed into a clevis.

* * * * *